United States Patent [19]

Penato et al.

[11] Patent Number: 4,670,895

[45] Date of Patent: Jun. 2, 1987

[54] X-RAY TUBE WITH A ROTARY ANODE AND PROCESS FOR FIXING A ROTARY ANODE TO A SUPPORT SHAFT

[75] Inventors: Jean M. Penato, Les Essarts le Roi; Paul Hery, Hay les Roses; Claude Bouhnik, Choisy le Roi, all of France

[73] Assignee: Thomson-CGR, Paris, France

[21] Appl. No.: 748,383

[22] Filed: Jun. 25, 1985

[30] Foreign Application Priority Data

Jun. 29, 1984 [FR] France ..... 84 10359

[51] Int. Cl.[4] ..... H01J 35/10

[52] U.S. Cl. ..... 378/125; 378/144

[58] Field of Search ..... 378/144, 125–133, 378/143; 228/115, 128, 173.1, 173.2, 194, 212, 221, 263.19

[56] References Cited

U.S. PATENT DOCUMENTS

| | | | |
|---|---|---|---|
| Re. 31,568 | 4/1984 | Devine, Jr. | 378/143 |
| 2,195,314 | 3/1940 | Lincoln | 228/212 |
| 3,678,570 | 7/1972 | Paulonis et al. | 228/194 |
| 3,731,128 | 5/1973 | Haberrecker | 378/144 |
| 3,755,885 | 9/1973 | Polyakov et al. | 228/221 |
| 3,890,521 | 6/1975 | Shroff | 378/143 |
| 3,900,751 | 8/1975 | Holland et al. . | |
| 4,146,165 | 3/1979 | Lesgourgues et al. | 228/194 |
| 4,276,493 | 6/1981 | Srinivasa et al. | 378/144 |
| 4,367,556 | 1/1983 | Hübner et al. | 378/144 |
| 4,574,388 | 3/1986 | Port et al. | 378/144 |

FOREIGN PATENT DOCUMENTS

| | | | |
|---|---|---|---|
| 55828 | 7/1982 | European Pat. Off. . | |
| 0003181 | 1/1980 | Japan | 378/128 |
| 0160889 | 12/1981 | Japan | 228/128 |
| 0095051 | 6/1982 | Japan | 378/144 |
| 0119142 | 7/1983 | Japan | 378/144 |
| 0123645 | 7/1983 | Japan | 378/144 |
| 2062953 | 5/1981 | United Kingdom . | |

*Primary Examiner*—Craig E. Church
*Assistant Examiner*—John C. Freeman
*Attorney, Agent, or Firm*—Pollock, VandeSande & Priddy

[57] ABSTRACT

The present invention relates to an X-ray tube with a rotary anode and to a process for fixing a rotary anode to a support shaft contained in such a tube. The rotary anode is fixed to the support shaft with the aid of a deformed element, positioned between the rotary anode and the support shaft, concentrically to the latter, and acting in the manner of a stuffing box.

13 Claims, 4 Drawing Figures

X-RAY TUBE WITH A ROTARY ANODE AND PROCESS FOR FIXING A ROTARY ANODE TO A SUPPORT SHAFT

BACKGROUND OF THE INVENTION

The invention relates to an X-ray tube with a rotary anode usable in the general field of radiology and more particularly appropriate for the case where the rotary anode is subject to great accelerations. It also relates to a process making it possible to fix a rotary anode to a support shaft.

The rotary anodes of X-ray tubes are generally shaped like a disk. The disk is fixed to a shaft, which is itself connected to the rotor, the assembly being rotated by a rotary magnetic field to which the rotor is exposed. The rotating rotary anode is exposed to very high thermal and mechanical stresses.

Thus, the X-radiation is obtained under the action of electron bombardment of a small surface of the anode and a very small part of the electrical energy used for accelerating the electrons is converted into X-rays. The rest of this energy is dissipated as heat in the rotary anode. In addition, the rotary anode is exposed to very significant thermal shocks and can reach very high temperatures. The mechanical stresses are particularly lined with high rotation speeds and high accelerations to which the rotary anode is exposed.

Generally the anode is fixed to the shaft connecting it to the rotor by fixing means acting by gripping. Under the effect of the aforementioned stresses, the rotary anode tends to be loosened and move during rotation with respect to its support shaft. This can lead to an unbalance of the rotary anode - rotor assembly, with the appearance of vibrations and risks of mechanical breaks.

This problem of fixing the rotary anode to the shaft connecting it to the rotor exists with all types of rotary anodes. However, this problem is even more critical in the case of graphite anodes, due to differences between the expansion coefficients of graphites and the support shaft, and on the friction coefficient of graphite, which is a material having a lubricating tendency.

Examples are given below of various methods attempting to obviate this problem.

(a) pins or keys engaged in the anode and support shaft, according to transverse axes with respect to the latter, but this solution is not very effective in the case of graphite anodes, due to the friable character of graphite;

(b) support shafts provided with off-centered bosses, but this solution suffers from the disadvantage that it leaves a very large mechanical clearance between the anode disk and the support shaft;

(c) a further very different solution consists of brazing the anode on its support shaft. This solution ensures a good connection between anode and support shaft, although the operation is difficult to perform. In addition, it can limit the performances of the X-ray tube by reducing the quality of the vacuum existing in the latter, if the operating temperature leads the brazing materials to have an excessive vapor tension. It is also pointed out that this fixing by brazing prevents any subsequent disassembly;

(d) European Patent Application No. 0 055 828 describes the construction in the same graphite block of the anode disk and its support shaft, in order to transfer the graphite - metal junction into a lower temperature zone, as it is further away from the anode disk. Apart from its very high cost, this configuration is mechanically very fragile, due to the limited mechanical strength of graphite.

(e) French Patent Application No. 2 467 483 describes a construction in which a pyrolitic graphite sleeve is brazed into the graphite anode disk body. However, this solution is very expensive to perform, due to the difficult and mechanically fragile construction.

This list of the various methods aiming at fixing the rotary anode to its support shaft shows that the problem caused by this fixing is of great importance to all X-ray tube designers. It also shows that this problem has not been satisfactorily solved.

SUMMARY OF THE INVENTION

The present invention relates to an X-ray tube with a rotary anode, in which the fixing of the rotary anode disk to its support shaft is reliably accomplished by simple, easily performable means and which also permits dismantling of the anode disk. The invention also relates to a process for fixing the rotary anode to a support shaft.

The present invention specifically relates to an X-ray tube with a rotary anode having a rotor and a support shaft positioned and joined along a longitudinal axis about which the rotary anode is rotated. The rotary anode having first and second opposite faces, between which it has an issuing hole arranged along its longitudinal axis, the support shaft being engaged in the issuing hole, and one deformed element is provided in a recess concentric to the support shaft, the recess being formed between the support shaft and one wall of the issuing hole, so as to fix the rotary anode to the support shaft.

BRIEF DESCRIPTION OF THE DRAWINGS

The invention is described in greater detail hereinafter relative to non-limitative embodiments and the attached drawings, in which.

DETAILED DESCRIPTION OF THE INVENTION

Figures 1, 2:
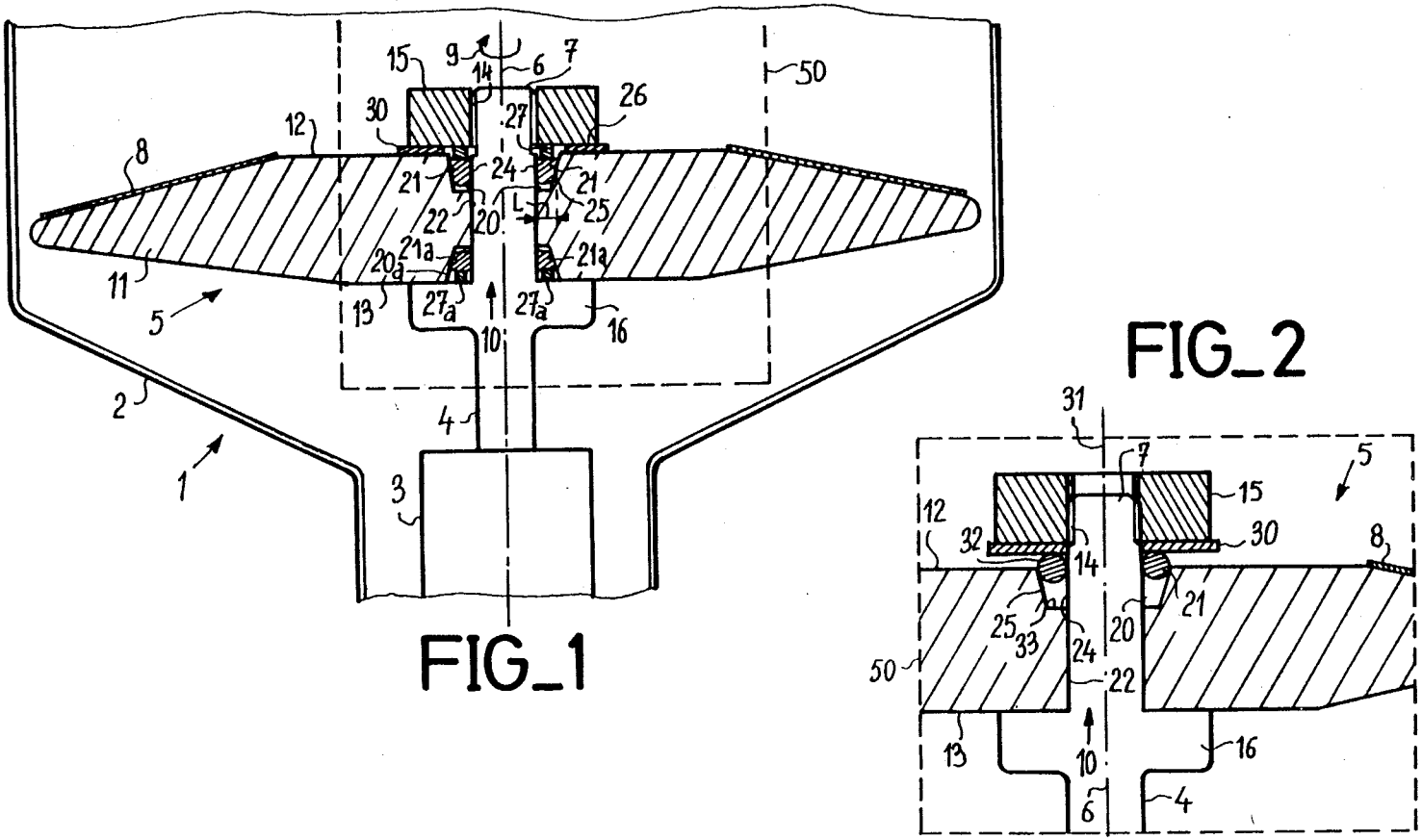
FIG. 1 shows partly, and in a sectional view, the preferred embodiments of an X-ray tube according to the invention.
FIG. 2 more especially and in a sectional view, characteristic means of the invention contained in a frame shown in FIG. 1.

FIG. 1 shows an X-ray tube 1 having in an envelope 2, a rotor 3, a support shaft 4 and a rotary anode 5. With the exception of the means used for fixing and locking the rotary anode 5, relative to the support shaft 4, X-ray tube 1 is of a conventional type, the other means which conventionally equip the tube not being shown.

Rotor 3 and support shaft 4 are arranged and joined along a longitudinal axis 6, about which they bring about the rotation of anode 5, e.g. in accordance with arrow 9. In this preferred embodiment, the rotary anode 5 is formed from a graphite disk 11, on which is deposited a tungsten coating 8. The rotary anode 5 has an axis of symmetry coinciding with the longitudinal axis 6, along which it is traversed between its first and second opposite faces 12, 13 by an issuing hole 10 which, in the present embodiment, has a not shown circular cross-section.

Support shaft 4 has a shoulder 16 from which its end 7 is engaged in the issuing hole 10 of rotary anode 5, along longitudinal axis 6. The second face 13 of the rotary anode 5 abuts against shoulder 16.

Rotary anode 5 is fixed to its support shaft 4 by means of a deformed element 21, arranged concentrically to support shaft 4 and contained in a recess 20 formed between shaft 4 and a wall 22 of issuing hole 10. In the present embodiment, recess 20 is constituted by a groove, which is also concentric to the support shaft 4, formed by the wall 22 of issuing hole 10 and open both on the first face 12 of rotary anode 5 and on the support shaft 4.

Thus, recess 20 has a first wall 24 formed by the actual support shaft 4 and a second wall 25 which faces the first. This second wall belongs to the rotary anode 5.

The second wall 25 can be parallel to the first wall 24, or as in the embodiment described, can slope with respect to the latter, the groove forming the recess 20 then being a conical groove.

The deformable element 21 is constituted, for example by a closed or non-closed ring, or a retaining ring which, before deformation has a diameter (not shown in FIG. 1) equal to or larger than the average width L of recess 20, considered between its two walls 24, 25. The retaining ring constituting the deformed element 21 is made from a refractory material with a low vapor tension and of a relatively plastic nature, such as tantalum or niobium.

The deformed element 21 grips around the support shaft 4 at the first wall 24 and defines between the first wall 24 and the second wall 25 belonging to the rotary anode 5, (not shown) forces which bring about the locking of rotary anode 5 with respect to the support shaft 4.

According to the same fixing principle of rotary anode 5 on support shaft 4, recess 20 and the deformed element 21 contained therein can be positioned on the side of the second face 13 towards shoulder 16, where they are respectively designated 20*a*, 21*a* in FIG. 1. In this case, recess 20*a* is open on the side of the second face 13, the deformed element 21 enclosing the support shaft 4 in the same way as in the preceding case.

These two methods for fixing the rotary anode 5 to its support shaft 4 can be used either separately or simultaneously. In this first version of the X-ray tube shown in FIG. 1, end 7 of support shaft 4 also has a thread 14, onto which is screwed an axial nut 15. Nut 15 and thread 14 also constitute a means for fixing the rotary anode 5 to its support shaft 4, which also plays a part in the following process of deforming the deformable element or retaining ring from which the deformed element 21 is obtained.

In the preferred embodiment shown in FIG. 1, nut 15 has on its inner face 26 a ring or collar 27, which is also concentric to the support shaft 4. According to the process of the invention which will be described in greater detail hereinafter relative to FIG. 2, when nut 15 is screwed on to thread i4 until it is locked on the first face 12 of rotary anode 5 via a washer 30, collar 27 enters recess 20 and bears against the retaining ring 21. Thus, on tightening nut 15, the retaining ring 21 is introduced into the groove or recess 20 and grasps the support shaft 4 while deforming, the assembly acting in the manner of a stuffing box.

In the same way, if rotary anode 5 is provided on the side of its second face 13 with a recess 20*a*, having a retaining ring 21*a* and the shoulder 16 also has a second collar 27*a* acting in the same way as the first collar 27, the tightening of nut 15 leads to the insertion of the retaining ring 21*a* in groove or recess 20*a*. As in the preceding example, the retaining ring 21*a* grasps the support shaft 4 and deforms.

It is pointed out that the first or second collar 27, 27*a* is not necessary for obtaining the deformation of the retaining ring 21, 21*a*, for example, the diameter of ring 21, 21*a* is such that before being deformed it passes beyond the plane of the first or second face 12, 13. This will be explained in greater detail relative to FIG. 2, which shows the elements contained in frame 50 in FIG. 1.

FIG. 2 illustrates the process of the invention, applicable to the fixing of a rotary anode 5 to a support shaft 4. Rotary anode 5 is of the type having an issuing hole 10 between its opposite faces 12, 13, and along an axis of symmetry 31 perpendicular to its plane. The issuing hole 10 serves to receive the end 7 of support shaft 4, the axis of symmetry 31 then coinciding with the longitudinal axis 6 of support shaft 4.

On the basis of such a rotary anode, the process consists of machining the anode in order to form at least one recess 20 open on one of the faces 12, 13, e.g. the first face 12, as shown in the preferred embodiment of FIG. 2. Then, after, e.g. engaging end 7 of support shaft 4 in the issuing hole 10, it consists of placing the retaining ring 21 in recess 20. It is pointed out that in this phase of the process, ring 21 abuts in recess 20 against the walls 24, 25 of the latter and has a portion 32 which projects relative to the plane of the first face 12.

Thus, the retaining ring 21 abuts, the following phase of the process consisting of deforming the retaining ring 21, so as to increase the surface and the force, according to which, on the one hand it is in contact and embraces the support shaft 4, i.e. the first wall 24, and on the other hand according to which it is in contact with the rotary anode 5, i.e. the second wall 25. This deformation of the retaining ring 21 can even bring it into contact with the bottom 33 of recess 20.

In the non-limitative embodiment of a first version of the process according to the invention, the deformation of the retaining ring 21 is obtained by tightening nut 15 onto thread 14. In this non-limitative embodiment, nut 15 bears on portion 32 of retaining ring 21 via washer 30 and on tightening nut 15 to bring the washer 30 into contact with the upper face 12, the retaining ring 21 is introduced into recess 20 and grasps the support shaft 4 and deforms. The appearance of the retaining ring is similar to that of FIG. 1.

At this stage of the process, rotary anode 5 is fixed to the support shaft 4 in a considerably improved manner compared with the prior art. With the aim of further improving this fixing, the process according to the invention also makes it possible to reinforce the connection between deformed element 21 and support shaft 4, by providing a type of weld between them.

To this end, the process also consists of heating the support shaft 4 and the deformed element 21 to raise them to a temperature of approximately 1500° C. Tests have revealed good results from 1200° C. and have revealed that it is not desirable to exceed 1600° C.

This heating is preferably performed on that part of the anode—support shaft assembly 5—4 located around the issuing hole 10. Such a localized heating can, e.g., be obtained by electron bombardment produced by conventional means (not shown).

The support shafts for the rotary anodes, such as support shaft 4, are generally made from molybdenum or from a molybdenum-based alloy. The heating of the support shaft 4 and the deformed element 21 makes it possible to aid interdiffusion phenomena between the molybdenum and the material from which the deformed element 21 is made, e.g. tantalum. This interdiffusion constitutes a type of weld, which considerably improves the adhesion of the deformed element 21 to the support shaft 4.

Figure 3:
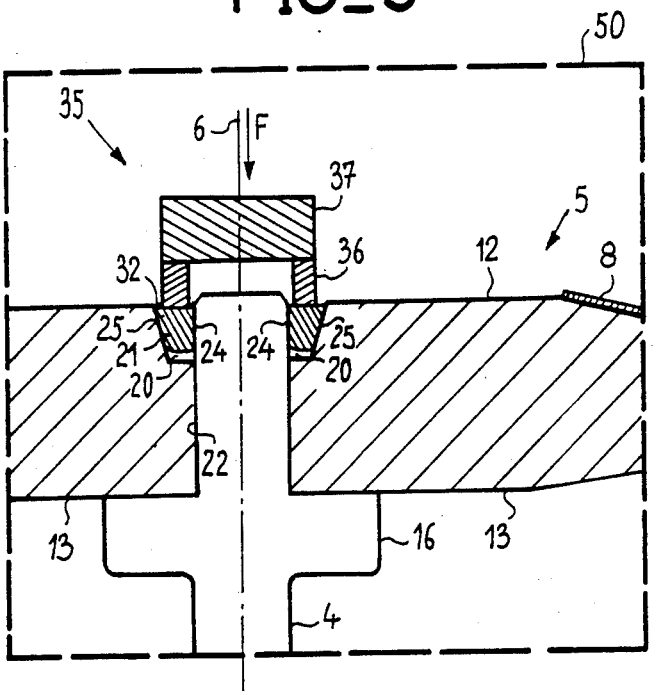
FIGS. 3 and 4 show respectively means contained in the frame of FIGS. 1 and 2, according to first and second embodiments of the present invention.

FIG. 3 illustrates another version of the process according to the invention in which the deformation of the deformable element or retaining ring 21 is obtained with the aid of a tool 35, and in which thread 14 and nut 15 are eliminated.

In this version of the process, the retaining ring 21 is placed in the recess 20 so as to abut against the first and second walls 24, 25. It is then inserted in recess 20 with the aid of a tool 35, so as to obtain its deformation in the same way as the previous example, but under the effect of momentary action of tool 35. The latter can, e.g., have a third collar 36, concentric to support shaft 4 and bearing against portion 32, while projecting beyond the retaining ring 21. As in the non-limitative embodiment described, the third collar 36 can be surmounted by a solid part 37, to which is momentarily applied in the axial direction a force F necessary for the insertion and deformation of the deformable element for retaining ring 21. This force F can be produced by conventional means, such as, e.g., a not shown press.

At this stage of the process according to the invention, rotary anode 5 is fixed reliably to the support shaft 4, solely by the action of the deformed element 21 or the retaining ring, thread 14 and nut 15 being eliminated. It is pointed out that the elimination of thread 14 and nut 15 leads to a significant price reduction in the case of the X-ray tube 1 of the invention, bearing in mind the machining difficulties encountered in connection with the formation of a thread 14 and a nut 15, as well as the amount of waste produced by these machining operations.

The connection between support shaft 4 and deformed element 21 can also be improved, as a result of a localized heating, as explained in connection with the previous embodiment, which makes it possible to form a type of weld between support shaft 4 and deformed element 21.

In this case, tool 35 must remain in place during the heating, in such a way that force F is exerted during the interdiffusion phenomena between the material of the support shaft 4 and the material of the deformed element 21.

To oppose any pulling out of the rotary anode 5 from support shaft 4, in accordance with longitudinal axis 6, support shaft 4 and the second wall 25 of recess 20 can have striations (not shown), which are, e.g., produced during machining.

Figure 4:
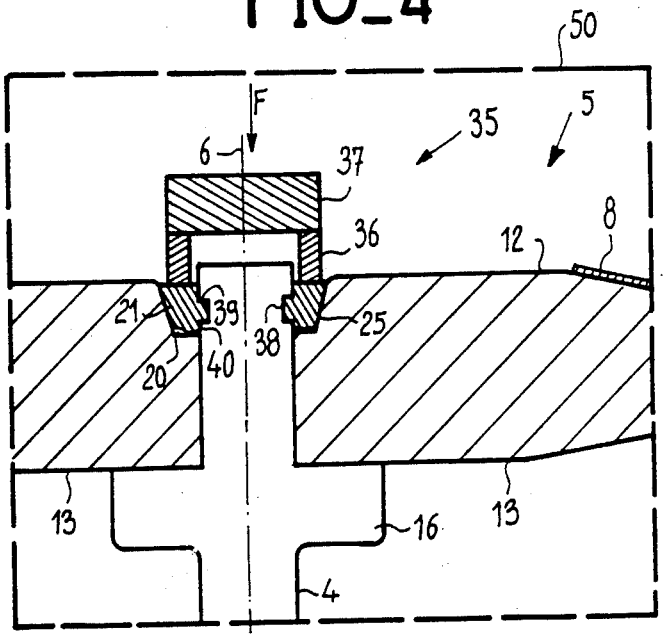

As shown in the embodiment of FIG. 4, support shaft 4 has at recess 20 a second groove 38, which forms part of recess 20. Under the pressure of force F, the deformed element 21 or retaining ring also enters groove 38 and assumes the shape thereof. Thus the sides 39, 40 of groove 38 form abutments opposing the pulling out of the rotary anode 5, in accordance with longitudinal axis 6. It is pointed out that the recess 20 can also have a second groove 38, in the case of the embodiments shown in FIGS. 1, 2 and 3.

The X-ray tube and process of the invention are applicable to all cases of X-ray tubes with rotary anodes and more particularly in cases where the rotary anode is exposed to significant accelerations and also where the rotary anode is constituted by a graphite disk.

What is claimed is:

1. An X-ray tube comprising:

a rotary anode having first and second opposite faces;

an axial bore passing through a central portion of the rotary anode, the bore extending into at least one enlarged coaxial recess which is formed inwardly of a first corresponding anode face;

a rotating shaft coaxially received in the bore and recess; and at least one permanently deformed ductile ring located within the recess and press fitted between a wall of the recess and an adjacent section of the shaft so as to secure the anode to the shaft and preventing relative motion therebetween.

2. An X-ray tube as set forth in claim 1 further comprising a fastener engaging an end of the shaft and secured to the first anode face.

3. An X-ray tube as set forth in claim 1 wherein the recess further includes a coaxial groove formed in the wall of the shaft for receiving a portion of the deformed ring therein thus additionally securing the anode to the shaft.

4. An X-ray tube as set forth in claim 1 wherein:

a second anode face has a second recess formed therein;

a second deformed ductile ring is located within the second recess and is press fitted between a wall of the second recess and an adjacent section of the shaft; and the shaft has a shoulder formed therein for contacting the second face of the anode, the shoulder having a collar formed therein for deforming the second ring when the shoulder contacts the second face.

5. An X-ray tube as set forth in claim 1, wherein the ring is made from a refractory material having a low vapor tension.

6. An X-ray tube as set forth in claim 2, wherein the fastener has a collar formed therein for deforming the ring when said fastener is secured to said anode.

7. An X-ray tube as set forth in claim 5, wherein the ring is made from tantalum.

8. An X-ray tube as set forth in claim 5, wherein the ring is made from niobium.

9. A method for securing an X-ray anode to a rotatable shaft comprising the steps:

forming an axial bore through a central portion of the anode which extends into at least one enlarged coaxial recess which is formed inwardly of a first anode face;

positioning a rotatable shaft through the bore and recess;

placing a ductile ring within the recess; and subjecting the ring to forces causing permanent deformation of the ring until it becomes press fitted between a wall of the recess and an adjacent section of the shaft so as to secure the anode to the shaft and preventing relative motion therebetween.

10. An anode-securing method as set forth in claim 9, wherein the step of subjecting the ring to deformation forces occurs simultaneous with auxiliary fastening of the anode to the shaft.

11. The method set forth in claim 9, together with the step of heating the ring and shaft to a temperature between 1200° C. and 1600° C. for causing interdiffusion between material of the shaft and material of the ring so as to increase the adhesion between the ring and shaft.

12. The method set forth in claim 9, together with the step of forming a groove in the shaft for receiving a portion of the deformed ring thus additionally securing the anode to the shaft.

13. The method set forth in claim 11 wherein the deformation forces are maintained during heating.

* * * * *